US005649555A

United States Patent [19]

Harris

[11] Patent Number: 5,649,555

[45] Date of Patent: Jul. 22, 1997

[54] CURLING IRON WITH ROTATABLE BARREL

[76] Inventor: Virgil L. Harris, 3169 Cowpens Pacolet Rd., Spartanburg, S.C. 29307

[21] Appl. No.: 470,733

[22] Filed: Jun. 6, 1995

[51] Int. Cl.[6] ..... A45D 6/00

[52] U.S. Cl. ..... 132/238; 132/232

[58] Field of Search ..... 132/231, 232, 132/234, 237, 238, 239, 240, 241, 242, 271; 219/201, 222, 225

[56] References Cited

U.S. PATENT DOCUMENTS

| | | |
|---|---|---|
| 1,857,689 | 5/1932 | Melkman . |
| 1,929,012 | 10/1933 | Boda . |
| 2,524,058 | 10/1950 | Kamara . |
| 2,586,103 | 2/1952 | Smith . |
| 2,935,070 | 5/1960 | Auz . |
| 3,533,421 | 10/1970 | Mays . |
| 3,863,652 | 2/1975 | Selvoletto . |
| 4,211,914 | 7/1980 | Jackson . |
| 4,267,431 | 5/1981 | Rick et al. . |
| 4,443,688 | 4/1984 | Andis . |
| 4,468,554 | 8/1984 | Andis . |
| 4,591,695 | 5/1986 | Inoue . |
| 4,829,156 | 5/1989 | Thompson . |

FOREIGN PATENT DOCUMENTS

| | | |
|---|---|---|
| 1084381 | 8/1980 | Canada . |

*Primary Examiner*—Todd E. Manahan
*Attorney, Agent, or Firm*—Hardaway Law Firm, PA

[57] ABSTRACT

A rotatable curling iron is disclosed in which the barrel and clip portion may rotate along with a motor-driven shaft of the curling iron. A cable connects to the clip at one end, then passes through an opening and to an interior of a hollow drive shaft and runs along a length of the drive shaft before exiting the drive shaft through a terminal opening. The second end of the cable is in communication with a clip handle. One or more swivels are provided along the length of the cable which permits a portion of the cable to rotate along with the barrel and clip.

16 Claims, 3 Drawing Sheets

CURLING IRON WITH ROTATABLE BARREL

BACKGROUND OF THE INVENTION

This invention is directed towards an apparatus and process for using a rotating curling iron for hair styling. A variety of rotating curling irons are known, including U.S. Pat. No. 4,267,431 to Rick, et al and U.S. Pat. No. 4,211,914 to Jackson. Both disclose electric curling irons having a rotatable member. However, there remains much room for improvement in the art of hair curling devices.

SUMMARY OF THE INVENTION

The present invention provides a hair curling apparatus which overcomes difficulties and limitations present in prior curling iron devices.

It is the object of the present invention to provide a novel curling iron apparatus in which a cable and swivel apparatus is used to engage and facilitate rotation of the hair clipping portion of a rotating curling iron.

It is a further object of this invention to provide a rotating curling iron which has simpler construction and greater reliability than traditional rotating curling irons.

These and other objects of the invention are provided by a motorized, rotatable, electric curling iron apparatus having:

A hollow drive shaft having a first end in communication with at rotator and a second end defining a hair engaging member;

A cable in communication in a first end with a handle of the apparatus, a portion of the cable carried along an axis of the drive shaft and exiting the drive shaft through an aperture defined by an exterior wall of the shaft, a second end of the cable in communication with a clip carried by the hair engaging member;

A swivel having a first terminus and a second terminus positioned along the cable, the swivel permitting a rotation of the cable portion associated with the clip to rotate relative to the cable portion associated with the handle;

Wherein, when the drive shaft rotates, the clip and the associated cable rotates about the swivel relative to the cable portion in communication to the handle.

DETAILED DESCRIPTION

Figure 1:
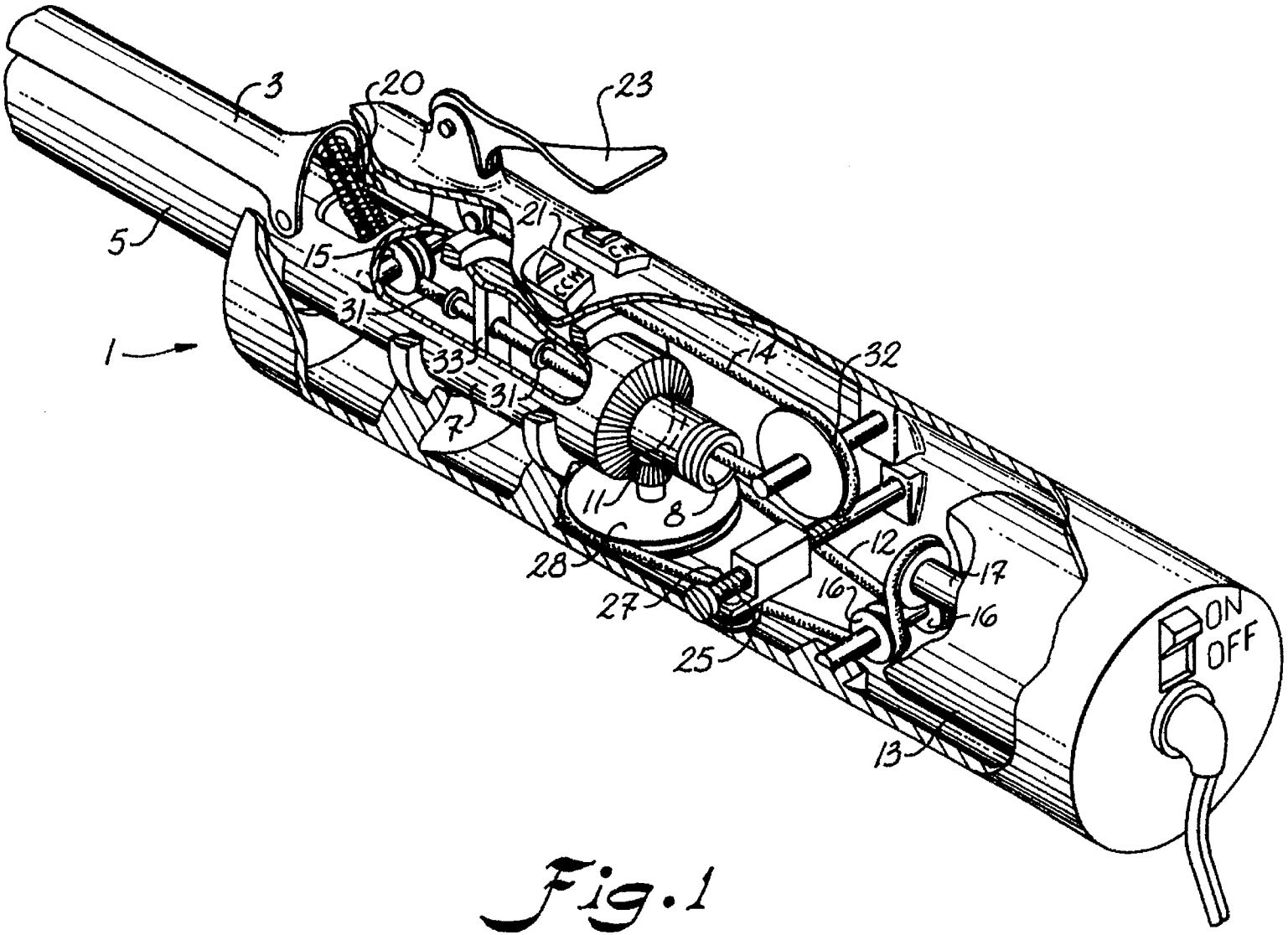
FIG. 1 is a perspective view in partial section and showing additional cut-away views of a preferred embodiment of the present invention.
Figure 2:
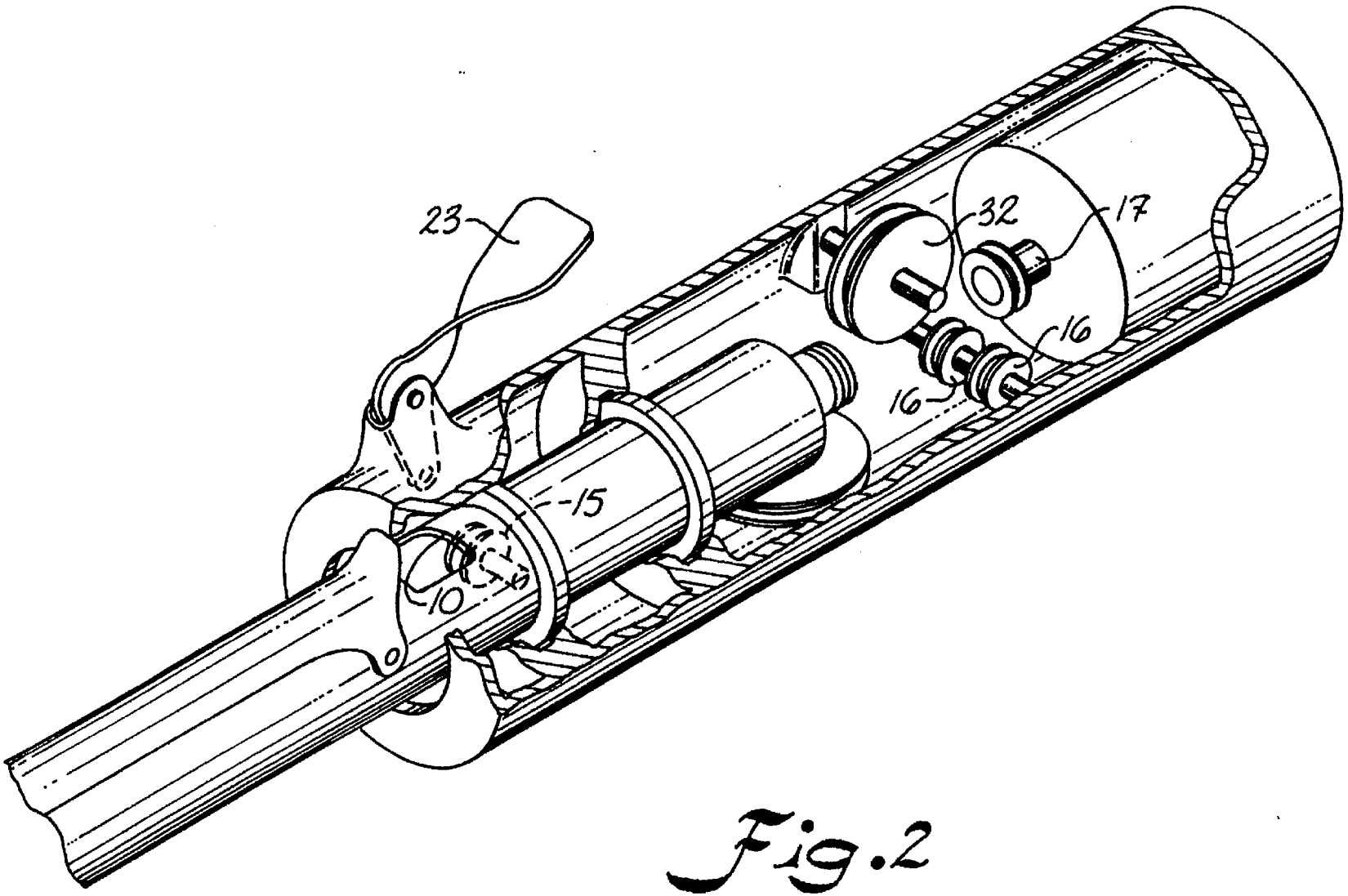
FIG. 2 is a perspective view in partial section with additional details in phantom of the preferred embodiment seen in FIG. 1.

It has been found that a simplified rotating curling iron apparatus can be provided in which the hair engaging clip and the barrel can rotate independently of the connecting handle. As seen in reference to FIGS. 1 and 2, the rotating curling iron 1 has an improved mechanism for rotating the clip 3 in heated barrel 5. As seen in FIGS. 1 and 2, an electrically heated barrel 5 is provided as is well know in the art. Clip 3 and barrel 5 are carried by a hollow drive shaft 7. Drive shaft 7 is engaged near a first terminus by a gear system 11 which interacts with a grooved, toothed portion of shaft 7. Gear system 11 may be belt driven and includes an endless belt 12 connected to a transverse mounted electric motor 13 and motor shaft 17. Belt 12 is preferably a rubber belt or other elastic material which allows the tension to be adjusted and provides a safety system designed to slip once a certain amount of rotational resistance is encountered.

A cable 14 connects at a first end to clip 3, entering the interior of drive shaft through an opening 10. A guide 15 is positioned within drive shaft 7 to maintain the proper position of cable 14 relative to the interior of the drive shaft. While guide 15 is illustrated as a pulley, a smooth surface eyelet, cone, or similar guide is possible to position and allow movement of the cable 14 as set forth below.

A momentary push button switch 21 is positioned near clip handle 23 and controls the operation and rotational direction of motor 13. Motor speed can also be regulated through a rheostat (not illustrated) or through a tension control device 25 which controls the safety slippage between motor shaft 17, pulleys 16, 28, and belt 12. A threaded carrier 27 is used to vary the tension exerted on belt 12.

In operation, the user depresses handle 23 opening clip 3 by the tension exerted along cable 14. The user's hair is engaged by the clip and the barrel as is conventionally known for curling irons, spring 20, closing the clip 3 when handle 23 is released. Switch 21 is then used to engage motor 13 which in turn rotates the shaft 7 in the desired direction. Barrel 5 and clip 3, carried by shaft 7, are thus rotated in either a clockwise or counterclockwise direction. A ball bearing swivel 31 enables the clip and part of the cable 14 to rotate freely within the barrel/shaft, allowing curling of the hair without manual rotation of the curling iron by the user.

Inherent safety features are part of the illustrated embodiment. Using a belt 12 and pulley 16 to engage the transmission and drive shaft, a controlled slippage can be provided. Proper selection of the electric motor will also limit the amount of torque, as well as provide a means for controlling the rotational speed of the curling iron. Preferably, it has been found that a rotation of 1–2 revolutions per second is a desirable speed, though the speed is adjustable by the user by use of a rheostat as well as proper size selection of pulleys 16, 28, and gear 11. Proper gear reduction and selection will enable a useful range of rotational speeds.

Cable 14 is preferably a wire cable such as piano wire which has the ability to flex and bend in all directions. The cable can withstand the heat which may occur in proximity to the heated barrel and clip and has a high tensile strength. One or more swivels 31 can be placed at various locations along the length of cable 14 to accommodate the rotation of the clip portion of the cable relative to the remaining cable being carried along the interior of shaft 7.

Figure 3:
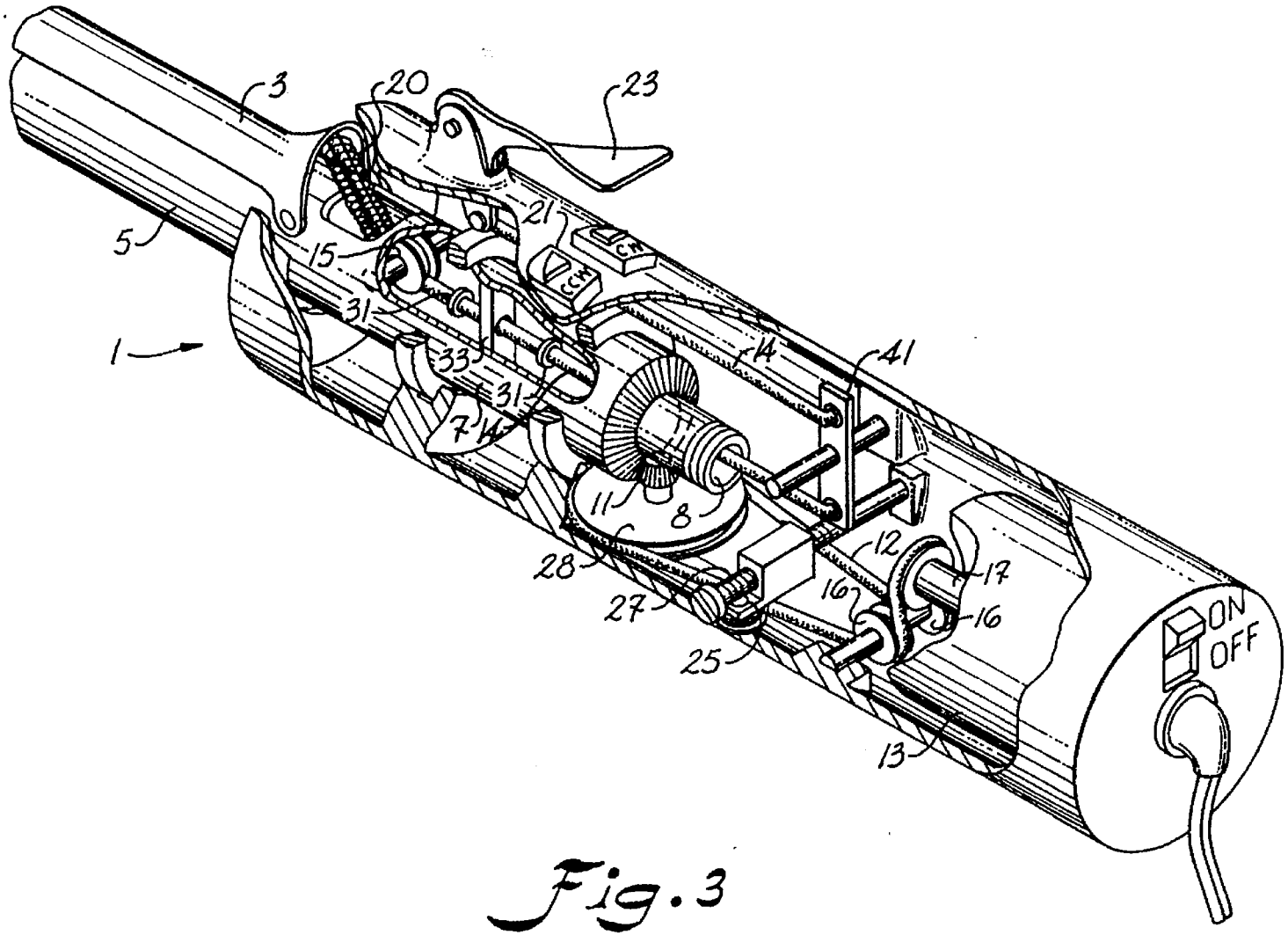
FIG. 3 is a perspective view of a pivoting lever and cable system which can be used to operate the apparatus of FIG. 1.

As seen in FIG. 3, a series of rods or cables connected to either end of a centrally pivoted lever 41 could be used in place of the pulley 32 and/or pulley 15 of the cable and pulley arrangement. While a pulley system is preferred, pulleys 32 and 15 may also include non-rotating pulley-shaped guides in which the cable slides relative to a grooved guide or other slidable member. Portions of cable 14 could be replaced by rods or similar structures. However, for ease of construction and assembly, a single length of cable interspersed with swivels is preferred. A cable support 33 prevents undesirable slack from occurring, thereby providing a more positive response when the handle is engaged and/or released.

A key feature of the present invention is the use of a swivel connector which selectively engages the clip. A swivel, preferably a ball-bearing or barrel type swivel prevents the cable from twisting and provides a compact and reliable means in which to engage the clip. The cable is easily carried within the hollow drive shaft and the swivel permits a portion of the cable and associated clip to rotate along with the barrel. Guide 15 maintains the cable along with the central axis of shaft 7 and permits a portion of the cable to exit the drive shaft through opening 10 and engage clip 3.

Similarly, in cable 14 is positioned along the interior shaft 7, a portion of the cable exits the base of the drive shaft and engages pulley 32 or similar apparatus support and reorient the cable toward handle 23. Pulley 32 or lever 41 or similar structure is designed to support and redirect the cable or rods toward handle 23 and to facilitate the smooth movement of the cable between drive shaft 7 and handle 23.

This system is easily constructed and lends itself to a number of different gear systems and motors. For instance, a direct drive motor can be provided, such motor being AC or DC, as well as using a pneumatic or hydraulic means to engage the drive shaft. The speed reduction ability of the gears and pulleys of the present invention enable the use of an inexpensive AC motor, avoiding the AC rectifier associated with DC motors. Also, well known safety clutches and drag systems are possible to provide safe operation of the curling apparatus. A battery operated rechargeable motor is also possible, such as systems being used with a butane or similar heat source for heating the barrel.

The ability to provide the necessary electrical connections to a rotatable barrel are well known within the art. Such electrical connecting details are not illustrated, but are set forth in the teachings and specifications of U.S. Pat. Nos. 4,267,431 and 4,211,914 which are incorporated herein by reference.

Numerous modifications of the preferred embodiment described above are possible to one having ordinary skill in the art and reading the description. Accordingly, the scope of the present invention is hereby set forth by the following appended claims.

That which is claimed:

1. A curling iron comprising:

a housing having an interior and an exterior, The interior of said housing carrying a first end of a barrel rotatably mounted to said housing;

a hollow drive shaft attached to and coaxial with a first end of said barrel, said shaft defining an opening at a terminus;

a clip pivotally mounted on a free end of said barrel;

a means for rotating the hollow drive shaft said said coaxial barrel;

a cable having a first end attached to a clip handle carried by said housing, said cable in further communication with an interior of said hollow drive shaft through said terminus opening of said shaft, a second end of said cable connected to said clip;

a swivel positioned along a length of said cable, said swivel permitting a portion of said cable attached to said clip to rotate relative to a second portion of said cable attached to said clip handle.

2. The curling iron according to claim 1 herein said swivel is located within said hollow drive shaft.

3. The curling iron according to claim 1 wherein a plurality of swivels are carried by said cable.

4. The curling iron of claim 1 wherein said rotating means comprises an electric motor, said motor operably connected to said hollow drive shaft by a drive belt.

5. The curling iron of claim 4 wherein said rotating means further comprises a tension control apparatus for varying the tension of said drive belt.

6. The curling iron of claim 1 wherein guide is housed within an interior of said hollow drive shaft for directing said cable from said clip along an interior of said drive shaft.

7. The curling iron of claim 1 wherein a pulley directs said cable from the terminal opening of said shaft to said clip handle.

8. A rotating curling iron comprising:

a housing;

a barrel carrying a clip pivotally mounted along a first free end of said barrel, a second end of said barrel in communication with an interior of said housing;

a hollow drive shaft carried within said housing and in coaxial communication with said second end of said barrel;

a means for rotating said drive shaft;

a cable in communication at a first end with said clip, said cable in further communication with an interior of said drive shaft through a first opening defined by said drive shaft, said cable passing through a length of said shaft and exiting through a terminal opening defined by said drive shaft, said cable in communication at a second end to a clip handle carried by an exterior surface of said housing;

a rotatable connector carried along a length of said cable, said connector permitting the rotation of a first length of cable relative to a second length of cable.

9. The curling iron apparatus of claim 8 wherein said rotatable connector is a swivel.

10. The curling iron of claim 8 wherein said rotating means comprises an electric motor, said motor operably connected to said hollow drive shaft by a drive belt.

11. The curling iron of claim 10 wherein said rotating means further comprises a tension control apparatus for varying the tension of said drive belt.

12. The curling iron of claim 8 wherein a guide is housed within an interior of said hollow drive shaft for directing said cable from said clip along an interior of said drive shaft.

13. The curling iron of claim 8 wherein a pulley directs said cable from the terminal opening of said shaft to said clip handle.

14. A rotating curling iron comprising:

a housing;

a barrel carrying a pivotally clip along a first free end of said barrel, a second end of said barrel in communication with an interior of said housing;

a hollow drive shaft carried within said housing and in coaxial communication with said barrel;

a means for rotating said drive shaft;

a means for connecting said clip to a clip handle, said connecting means in communication with an interior of said drive shaft through first opening defined by said drive shaft, said connecting means passing through a length of said shaft and exiting through a terminal opening defined by said drive shaft;

a rotatable connector carried along a length of said connecting means, said connector permitting the rotation of a first length of said connector means relative to a second length of said connector means.

15. The curling iron according to claim 14 wherein said means of connecting comprises a length of flexible cable.

16. The curling iron according to 14 claim wherein a lever directs said connecting means from said terminal opening of said shaft to said clip handle.

* * * * *